US008052581B1

(12) United States Patent
Lohr et al.

(10) Patent No.: US 8,052,581 B1
(45) Date of Patent: Nov. 8, 2011

(54) DUAL ACTUATION MECHANISM FOR BRAKING AND STOPPING ROTATION OF A ROTATING MEMBER

(75) Inventors: Josh Lohr, Madison, WI (US); Matt Wilson, Madison, WI (US); Jeff Iverson, Madison, WI (US)

(73) Assignee: Saris Cycling Group, Inc., Madison, WI (US)

( * ) Notice: Subject to any disclaimer, the term of this patent is extended or adjusted under 35 U.S.C. 154(b) by 0 days.

(21) Appl. No.: 12/652,441

(22) Filed: Jan. 5, 2010

(51) Int. Cl.
*A63B 22/06* (2006.01)

(52) U.S. Cl. ..... 482/63

(58) Field of Classification Search ..... 482/57, 482/63, 58–62; 280/247, 253, 256
See application file for complete search history.

(56) References Cited

U.S. PATENT DOCUMENTS

| | | | | |
|---|---|---|---|---|
| 2,623,502 | A * | 12/1952 | Lisle | 91/377 |
| 3,782,507 | A | 1/1974 | Shreve | |
| 4,023,796 | A * | 5/1977 | Kusmer | 482/126 |
| 4,235,436 | A * | 11/1980 | Lee | 482/63 |
| 4,480,720 | A | 11/1984 | Shimano | |
| 4,773,509 | A | 9/1988 | Sato | |
| 4,850,241 | A | 7/1989 | Buckley et al. | |
| 5,131,288 | A | 7/1992 | Barlas | |
| 5,230,676 | A * | 7/1993 | Terauds | 482/53 |
| 5,235,870 | A | 8/1993 | Hedstrom | |
| 5,339,929 | A | 8/1994 | Chern | |
| 5,507,712 | A * | 4/1996 | Chang | 482/126 |
| 5,540,304 | A | 7/1996 | Hawkins et al. | |
| 5,575,742 | A * | 11/1996 | Wu | 482/92 |
| 5,829,314 | A | 11/1998 | Scura | |
| 5,845,539 | A | 12/1998 | Huang | |
| 6,186,282 | B1 | 2/2001 | Juan | |
| 6,193,022 | B1 | 2/2001 | Bode | |
| 6,298,744 | B1 | 10/2001 | Huang | |
| 6,324,937 | B1 | 12/2001 | Chen | |
| 6,523,649 | B1 | 2/2003 | Juan | |
| 6,749,544 | B1 | 6/2004 | Chen | |
| 6,905,445 | B1 | 6/2005 | Lin | |
| 6,918,861 | B2 * | 7/2005 | Liao et al. | 482/57 |
| 6,968,927 | B2 * | 11/2005 | Scura | 188/24.16 |
| 7,278,958 | B2 * | 10/2007 | Morgan | 482/97 |
| 7,413,206 | B2 * | 8/2008 | Pena et al. | 280/246 |
| 2002/0151414 | A1 | 10/2002 | Baker | |
| 2005/0096192 | A1 * | 5/2005 | Chen | 482/63 |

* cited by examiner

*Primary Examiner* — Allana Lewin
(74) *Attorney, Agent, or Firm* — Boyle Fredrickson S.C.

(57) ABSTRACT

A dual actuation mechanism for controlling resistance applied to a rotating member includes a lever, a first actuator and a second actuator. The first actuator and second actuator are both operably coupled to the lever, wherein the first actuator and the second actuator move the lever independent of the other. For example, the lever may have a first slot for receiving the first actuator and a second slot for receiving the second actuator, wherein the first slot and second slot are sized such that when one actuator moves the lever, the other actuator is undisturbed because the respective slot moves with respect to the non-moving actuator. The dual actuation mechanism may be incorporated in an exercise cycle in which one of the actuators controls a level of resistance applied to a flywheel, and the other of the actuators selectively applies a stopping force to the flywheel.

20 Claims, 12 Drawing Sheets

DUAL ACTUATION MECHANISM FOR BRAKING AND STOPPING ROTATION OF A ROTATING MEMBER

BACKGROUND OF THE INVENTION

1. Field of the Invention

The present invention relates in general to a mechanism for applying resistance to a rotating member. A practical application of the mechanism of the present invention is in an exercise cycle, wherein the mechanism provides resistance as well as a brake for stopping rotation of a wheel of the exercise cycle.

2. Discussion of the Related Art

Exercise cycles typically include a system for applying resistance to rotation of a wheel, such as a flywheel, so that the user can adjust the intensity level of a workout as desired. In some exercise cycles, the resistance is applied manually. For example, the user may turn a knob having a threaded shaft that in turn applies resistance to the flywheel. Other exercise cycles may apply resistance using an electronically controlled device such as a motor. These types of exercise cycles may also include a manually operated brake, which is a completely separate system in and of itself.

There is thus a need for a mechanism that can be incorporated into exercise equipment, such as an exercise cycle, that provides both a manually operated brake and an actuator that allows the user to vary the level of resistance depending upon a desired workout intensity level. There is a further need for such a mechanism in which the manually operated brake and the actuator are components in a single assembly yet operate independently of each other. In other words, application of resistance by one of the components does not disturb or disrupt the functioning of the other component.

SUMMARY AND OBJECTS OF THE INVENTION

By way of summary, the present invention is directed to brake mechanism that includes a lever, a first actuator and a second actuator. The first actuator and second actuator each can move the lever independently of the other. A practical application of the inventive mechanism is in an exercise cycle, wherein the first actuator is a manually operated brake and the second actuator is an electronically controlled motor that applies incremental levels of resistance to the disc (or wheel) of the cycle. In the context of an exercise cycle, because the manually operated brake and the motor move the lever independently of one another, the manually operated brake can be used to override the motor by stopping the disc regardless of the level of resistance being applied by the stepper motor. On the other hand, movement of the lever by the stepper motor does not disturb or disable the manually operated brake.

A primary object of the invention is to provide a linkage-type actuation system having two actuators that, independent of the other, apply resistance to a rotating member such as a flywheel in an exercise cycle. It is a further object of the invention to reduce the complexity of the actuation system, which may be accomplished by using a motor as one of the actuators. It is a further object of the invention to substantially conceal the actuation system within a frame, e.g., of an exercise cycle, in order to prevent undesired interference with the operation of the actuation system. Still further, it is desirable to have a manually operated brake that can override an electronically controlled actuator.

In accordance with a first aspect of the invention, these objects are achieved by providing a linkage-type actuation mechanism that includes a lever that supports a resistance element. A first actuator and second actuator are operably connected to the lever, e.g., via respective slots in the lever. The first actuator and the second actuator move the lever independently of the other, or, in other words, without disrupting the functioning of the actuator that is not moving the lever.

In accordance with another aspect of the invention, a linkage-type actuation mechanism includes a lever that has a first slot and a second slot. A first actuator is operably coupled with the first slot, and a second actuator is operably coupled with the second slot. The first slot is sized and configured to allow for movement of the first slot with respect to the first actuator when the lever is moved by the second actuator. Conversely, the second slot is sized and configured to allow for movement of the second slot with respect to the second actuator when the lever is moved by the first actuator. Thus, for example, when the lever is moved by the second actuator, the first slot moves with respect to the first actuator so that the movement of the lever does not disrupt the functioning of the first actuator.

In accordance with yet another aspect of the invention, a method for applying resistance to a rotating member is performed using the inventive linkage-type actuation mechanism described herein. The method includes the steps of providing a lever having a resistance element configured to apply resistance to a disc; providing a first actuator that is operably coupled to the lever; providing a second actuator that is operably coupled to the lever; and applying resistance to the rotating member by actuating either the first actuator or the second actuator, wherein the first actuator and second actuator move the lever independently of the other.

These and other aspects and objects of the present invention will be better appreciated and understood when considered in conjunction with the following description and the accompanying drawings. It should be understood, however, that the following description, while indicating illustrated embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
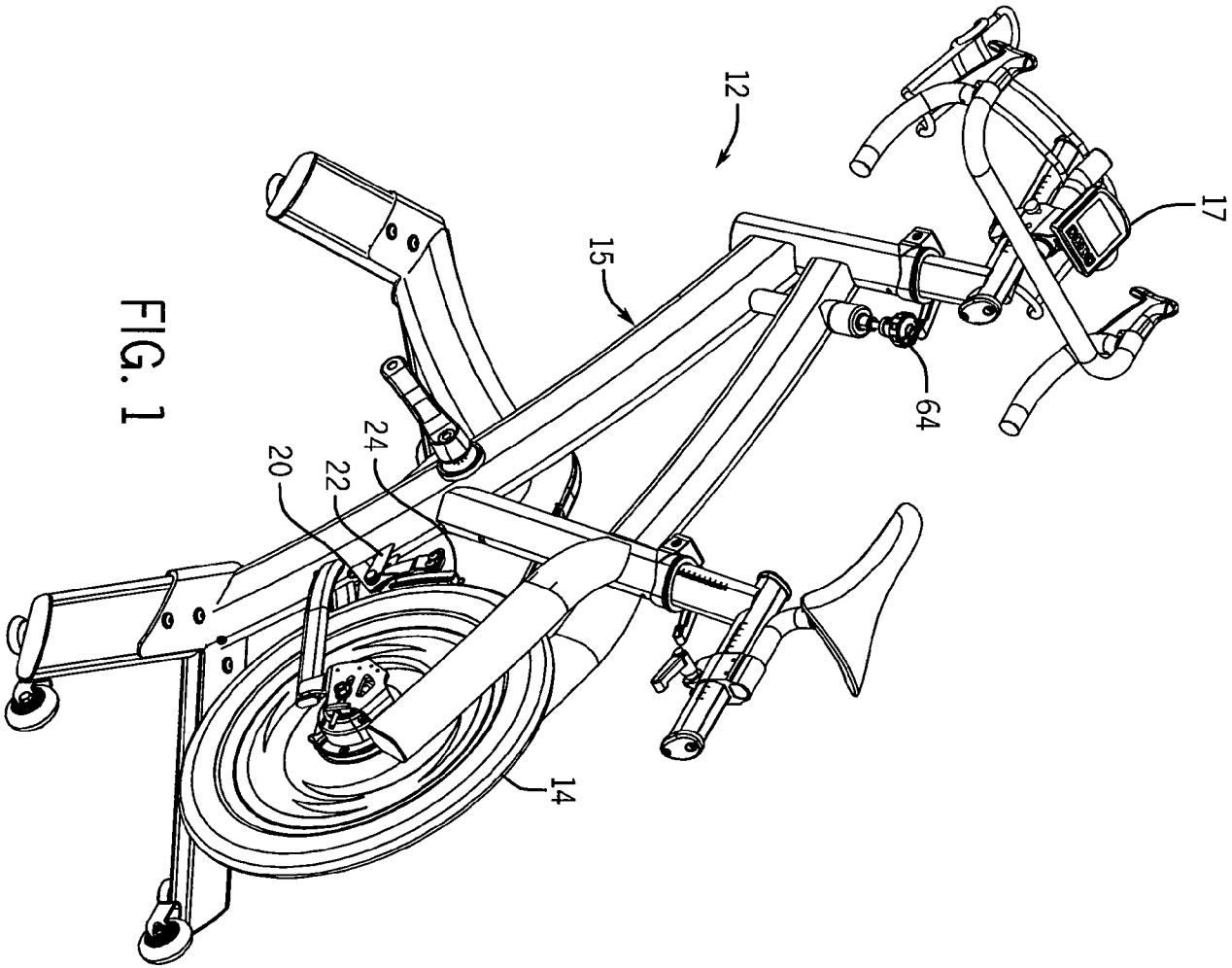
FIG. 1 illustrates an exercise cycle incorporating the dual actuation mechanism in accordance with the present invention.

In describing the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION

The present invention and the various features and advantageous details thereof are explained more fully with reference to the non-limiting embodiments described in detail in the following description.

Figure 2:
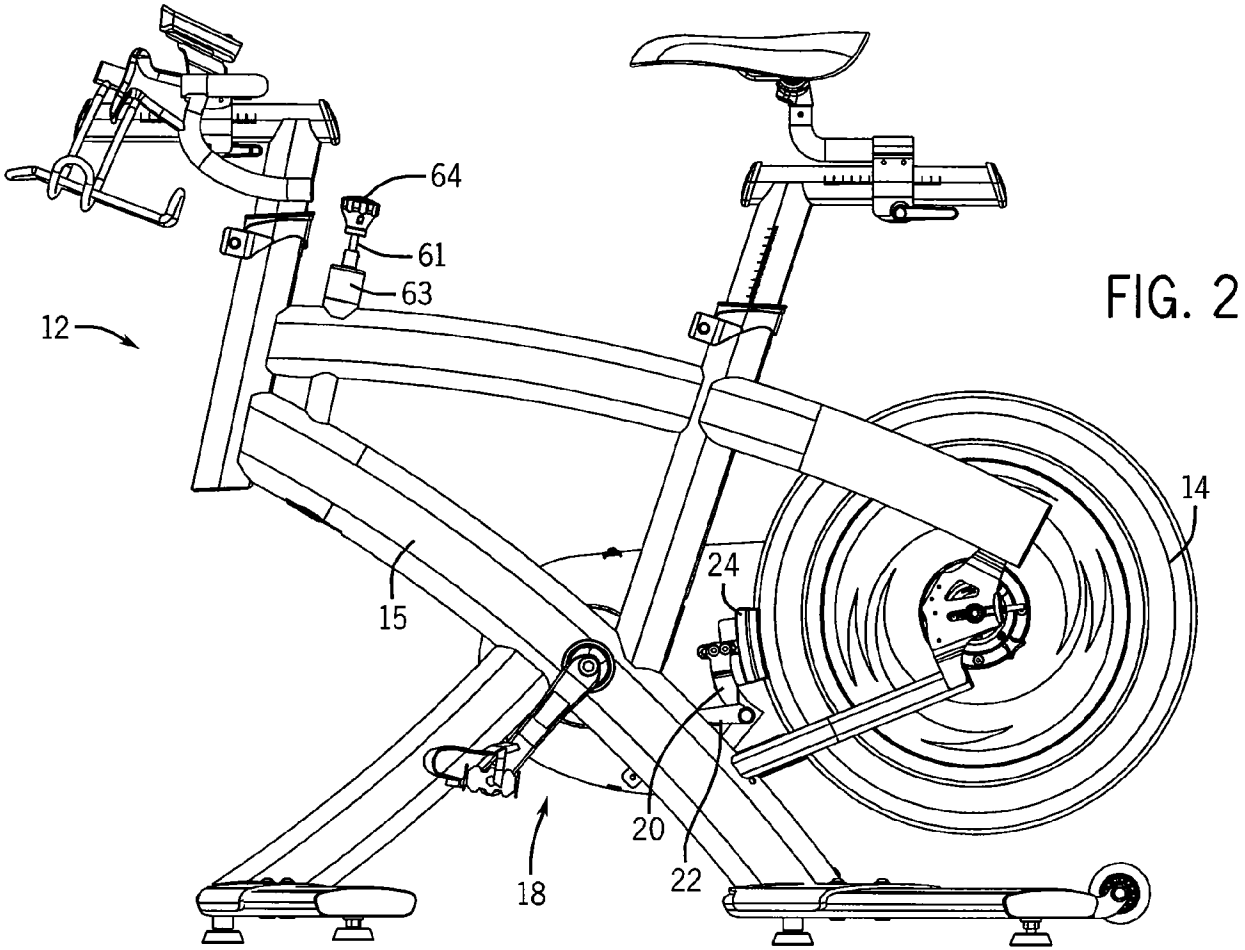
FIG. 2 illustrates a side elevation view of the exercise cycle of FIG. 1.
Figure 3:
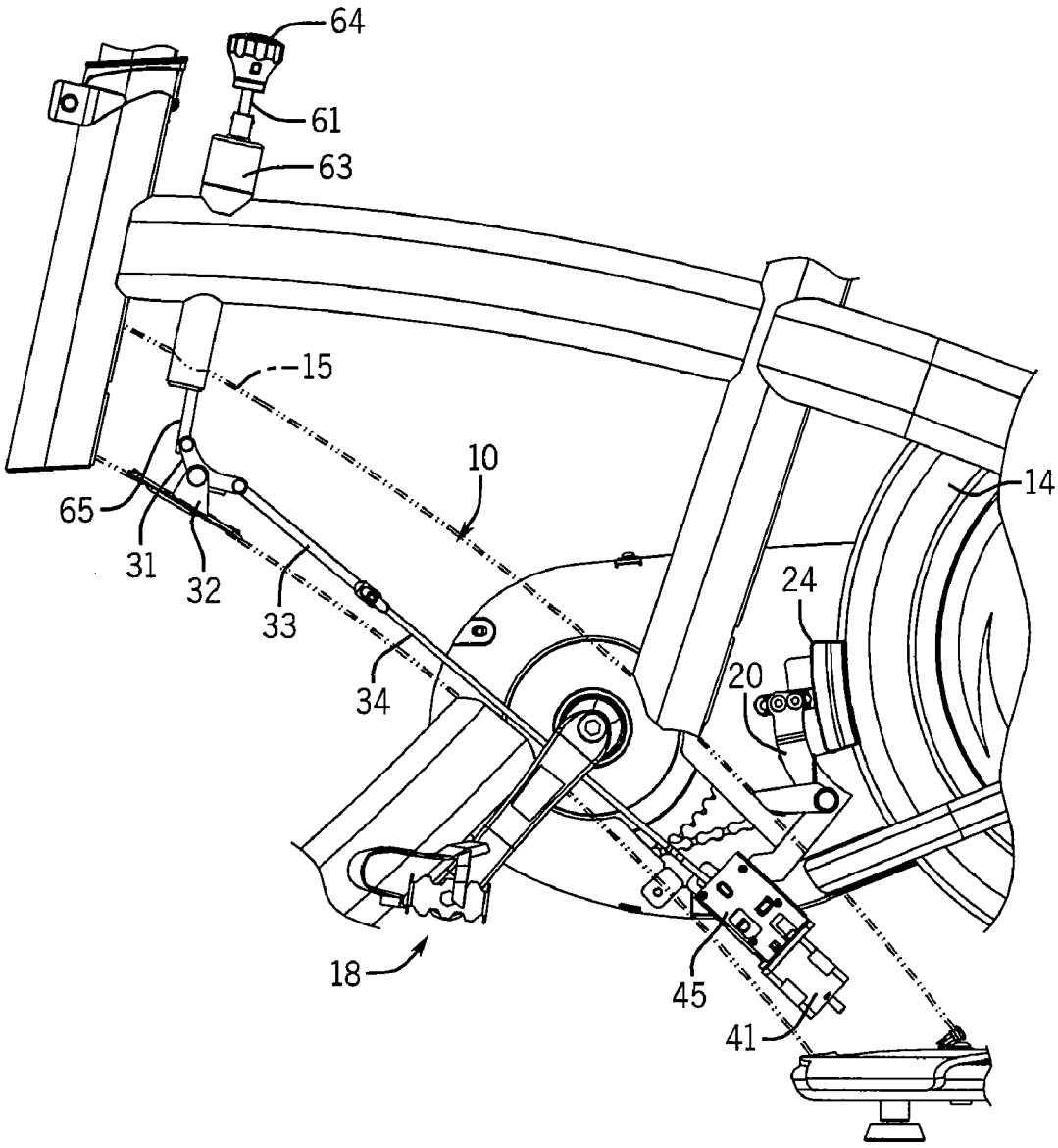
FIG. 3 illustrates a partial side elevation view of the exercise cycle of FIG. 1, with a portion of the frame removed, to reveal the dual actuation mechanism of the present invention.

Generally speaking, the present invention relates to a mechanism that includes two actuators for applying resistance to a rotating member. As shown in FIGS. 1-3, for example, a practical application of the mechanism of the present invention is in an exercise cycle 12 that includes a rotating member in the form of a flywheel 14 that is rotatably mounted to a frame 15. In this application, the first actuator is a brake that is manually actuated when the user applies an axial force to an actuator such as a button or knob. The second actuator is an electronically controlled motor-type actuator that provides different levels of resistance to rotation of the flywheel 14 based upon user input received at a user interface such as a handlebar-mounted computer 17. The manually operated brake and the motor-type actuator operate independently of each other. In other words, the motor-type actuator varies the resistance applied to the flywheel without disturbing or disabling the functioning of the manually operated brake, and likewise the manually operated brake may be applied with disturbing or disabling the functioning of the motor-type actuator.

Figure 4:
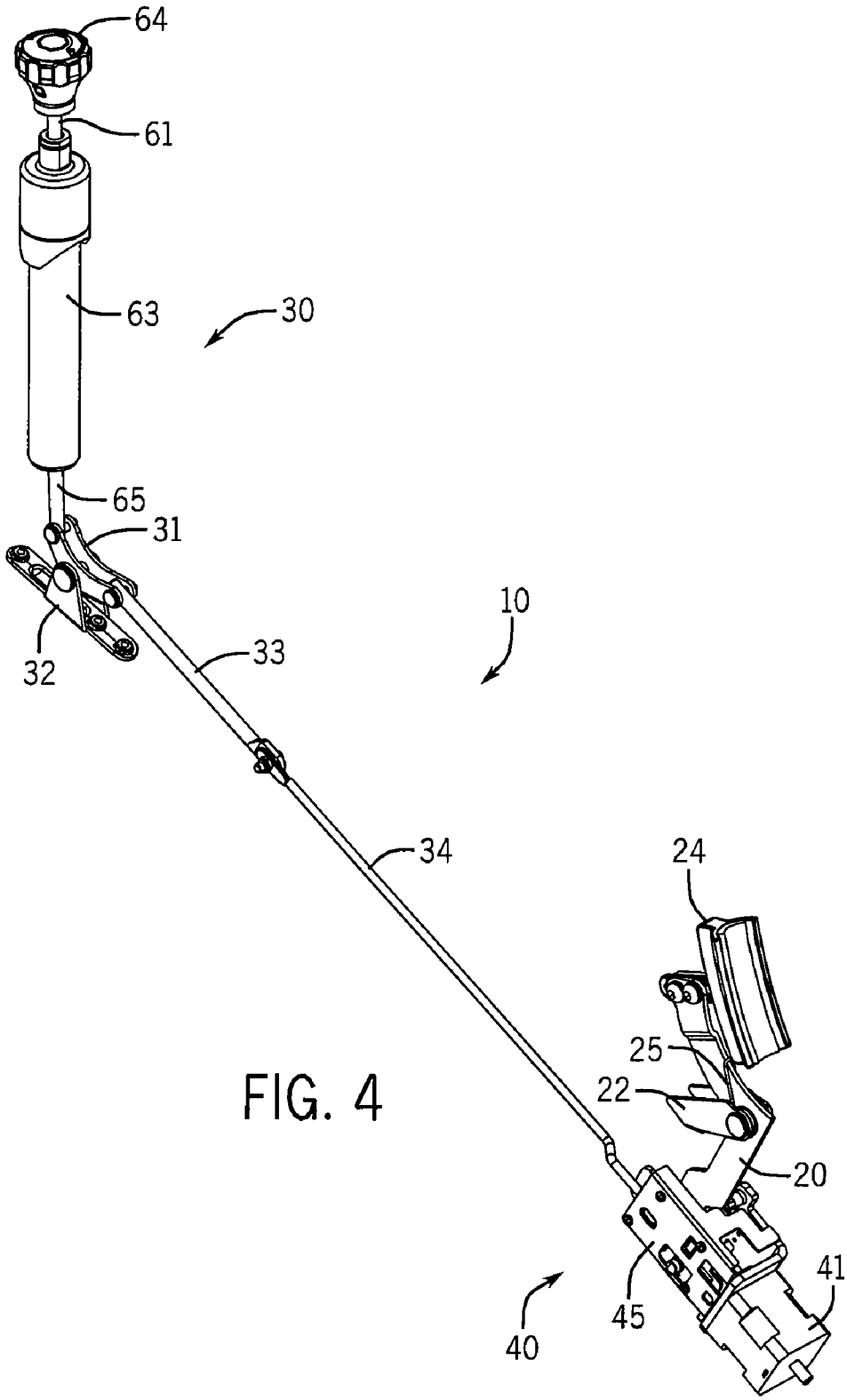
FIG. 4 illustrates an isometric view of the dual actuation mechanism of the present invention as shown in FIG. 3.
Figure 5:
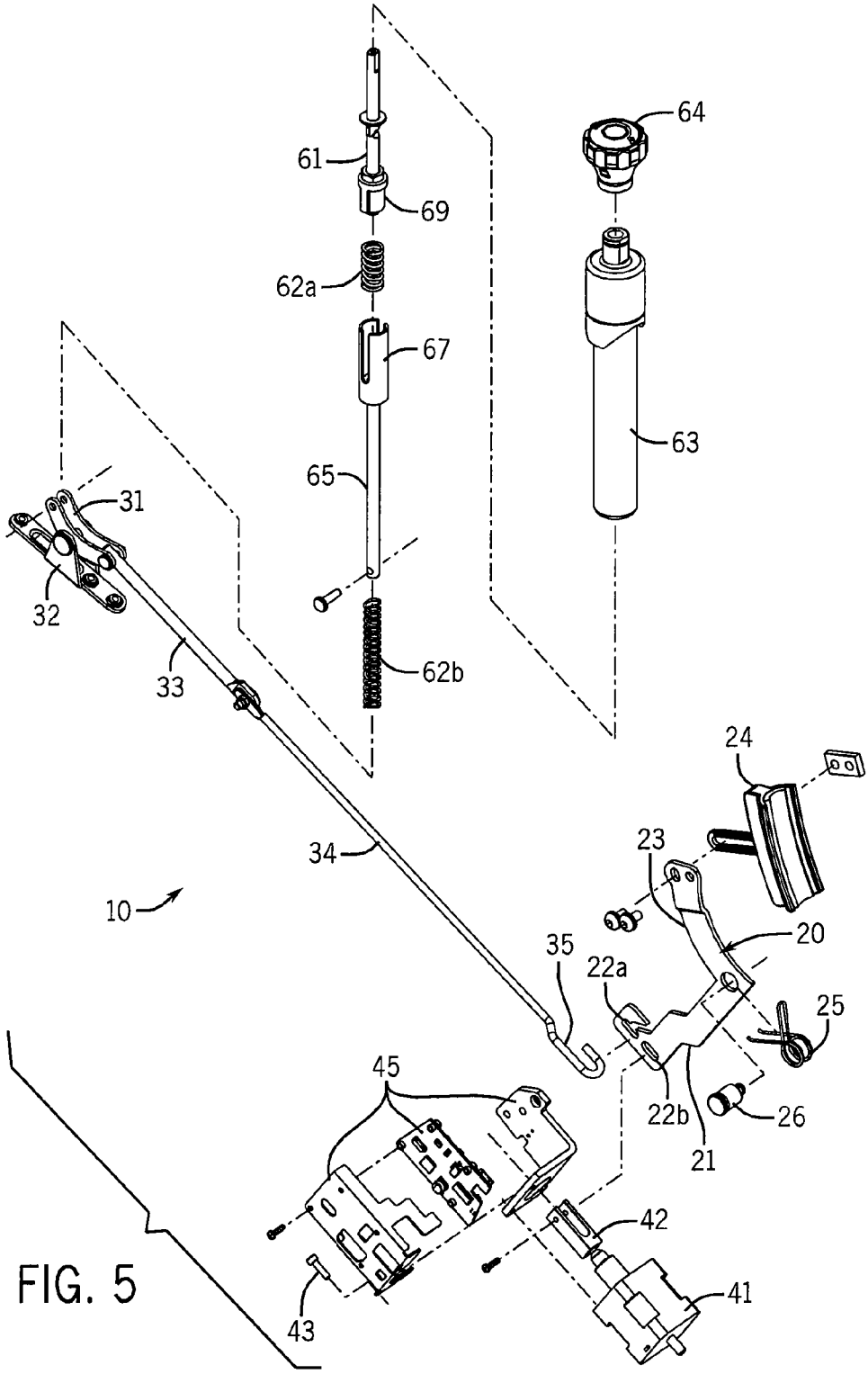
FIG. 5 illustrates an exploded isometric view of the dual actuation mechanism of FIG. 4.
Figure 6:
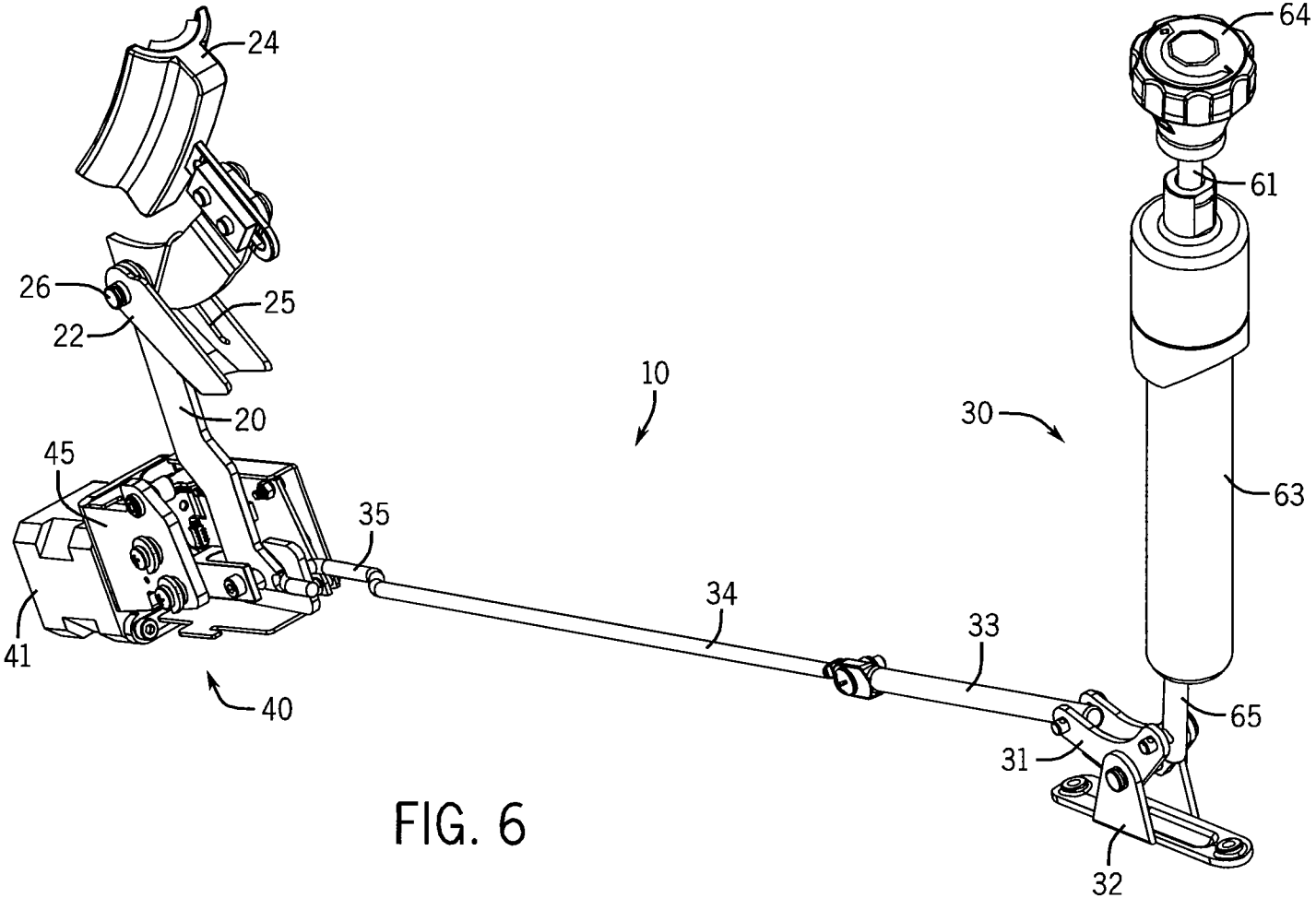
FIG. 6 illustrates another isometric view of the dual actuation mechanism of FIG. 4.

As shown in FIGS. 4-6, the dual actuation mechanism 10 of the present invention includes a lever 20, a first actuator 30, and a second actuator 40. In the illustrated embodiment, wherein the dual actuation mechanism 10 is incorporated into exercise equipment, namely an exercise cycle, the first actuator 10 functions as a brake that is manually actuated by a user, e.g., a person riding on the exercise cycle 12, in order to stop rotation of a rotating member of the exercise cycle, which may be in the form of the flywheel 14. The second actuator 40 may be in the form of a motor-type actuator, and representatively may be an electronically controlled stepper motor 41 that varies the level of resistance that is applied to the flywheel 14, e.g., to offer the user various options with respect to the strenuousness of a workout. For example, the user can input a desired workout level, e.g., 1-10 in level of difficulty, via a user interface, e.g., a keypad and display unit, on the exercise cycle 12, and the stepper motor 41 will adjust the resistance accordingly.

The dual actuation mechanism 10 of the present invention is configured such that the lever 20 may be moved using either the first actuator 30 or the second actuator 40. Moreover, either the first actuator 30 or second actuator 40 may be used independently of the other. In other words, the first actuator 30 can be applied without affecting the functioning of the second actuator 40, and vice-a-versa. Thus, in operation, the first actuator 30 applies a first force in a first direction to the lever 20 that causes the lever 20 to move without disturbing the second actuator 40. Conversely, the second actuator 40 applies a second force in the first direction to the lever 20 that causes the lever 20 to move without disturbing the first actuator 30.

For example, when the dual actuation mechanism 10 is incorporated into an exercise cycle, a user can apply the first actuator 30, e.g., a manually operated brake, without affecting the controlled resistance being applied by the second actuator 40, e.g., stepper motor 41. In this scenario, the user presses a button or knob to actuate the manually operated brake and stop the spinning flywheel 14 (or other rotating member). When the user releases the button or knob, the manually operated brake no longer exerts a force on the lever 20. The lever 20 then returns under the force of a spring 25 to a position determined by the resistance setting of the stepper motor 41. Thus, while the stepper motor 41 is set to an initial resistance setting corresponding with a position of the lever 20 in relation to the flywheel 14, the manually operated brake can be used to stop the spinning flywheel 14. Once the manually operated brake is released, the lever 20, under the force of the spring 25, returns to the position corresponding with the initial resistance setting of the stepper motor 41.

Figure 8:
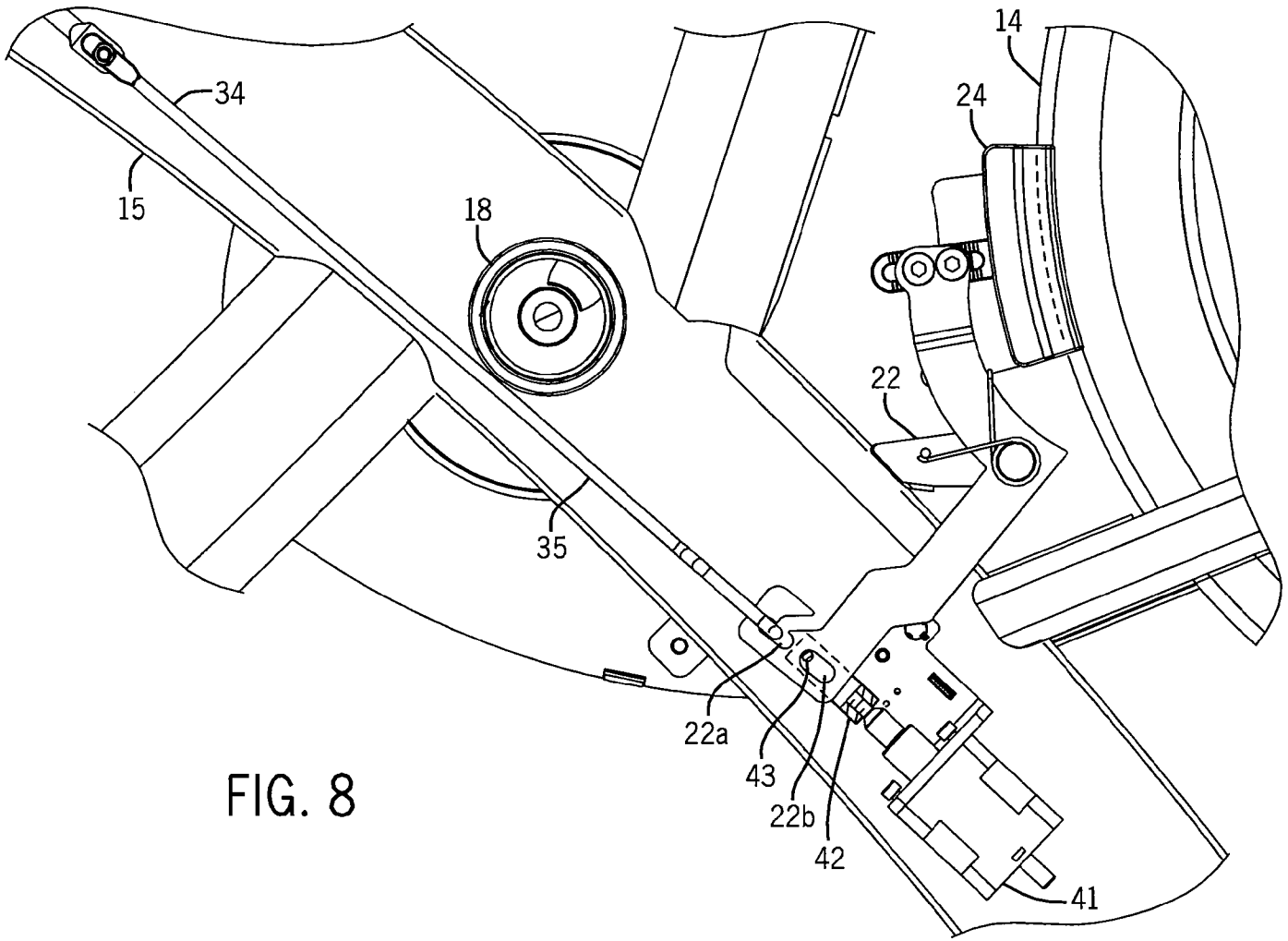
FIG. 8 illustrates another cross-sectional view of a portion of the exercise cycle and dual actuation mechanism of FIG. 1, showing a second actuator that applies resistance to the cycle flywheel, and showing the mechanism in a first position in which the lever is moved in response to operation of a motor-type resistance control.

As shown in FIGS. 5 and 8, in the illustrated embodiment the lever 20 may be in the form of a generally L-shaped member. However, the lever 20 may be any suitable size or shape that is capable of translating the respective forces applied by the first actuator 30 and second actuator 40. The lever 20 is pivotably supported by a bracket 22 that is secured to an external surface of the frame 15. As shown in FIGS. 4, 5 and 8, for example, the lever 20 rotates about a pin 26 that secures the lever 20 to the bracket 22 and defines the pivot axis about which the lever 20 is pivotable. The spring 25, which is in the form of a torsion spring, is also supported by the pin 26.

A first, proximal portion of the lever 20, shown at 21, engages the first actuator 30 and the second actuator 40, and is housed within the frame 15. A second, distal portion of the lever 20, shown at 23, is pivotally supported by the bracket 22 and supports a resistance element 24, and is positioned outside of the frame 15. Accordingly, parts of the dual actuation mechanism 10, e.g., the first actuator 30 and second actuator 40, as well as the proximal portion 21 of the lever 20, are located within the interior of the frame 15, and are thereby substantially concealed by the frame 15 and protected from undesired interference.

In the illustrated embodiment, the actuation of the lever 20 by either the first actuator 30 or second actuator 40, independent of one another, is accomplished by using slots 22*a* and 22*b* to engage the first actuator 30 and second actuator 40, respectively. In the illustrated embodiment the slots 22*a* and 22*b* are linearly aligned, though the slots 22*a* and 22*b* could be positioned in any desired orientation so long as they facilitate movement of the lever 20 by the first actuator 30 and second actuator 40. It should be noted that the term "slot" is intended to encompass an aperture or opening of any shape or size, so long as it is capable of receiving and providing engagement by a respective actuator. For example, as shown in FIG. 5, the slot 22*a* has an opening to the periphery of the lever 20 to provide easy attachment of the first actuator 30 to the lever 20. Slot 22*b* does not have such an opening, and first actuator 30 could be secured within the slot 22*a* in any other manner.

During operation, the first actuator 30 actuates the lever 20 by exerting a pulling force on the lever 20 via slot 22*a*. The second actuator 40 actuates the lever 20 by exerting a pushing force on the lever 20 via slot 22*b*. Accordingly, when the first actuator 30 is actuated (thus exerting a pulling force on the lever 20), the second actuator 40 does not exert a pushing force on the lever 20 because the second actuator 40 becomes temporarily disengaged from the lever 20 by movement of second actuator 40 within slot 22*b*. Conversely, when the second actuator 40 is actuated (thus exerting a pushing force on the lever 20), the first actuator 30 does not exert a pulling force on the lever 20 because the first actuator 30 becomes temporarily disengaged from the lever 20 by movement of first actuator 30 within slot 22*a*.

It should be noted, however, that variations in the size of slots 22*a* and 22*b* coupled with variations of the respective ranges of motion of the first actuator 30 and second actuator 40 can be used to implement desired levels of control over the system. For example, when the dual actuation mechanism 10 is incorporated into an exercise cycle, it is desirable to allow for the first actuator 30, e.g., a manually operated brake, to be able to stop the spinning flywheel 14 at any time, regardless of the positioning of the second actuator 40, e.g., a motor 41 that may be a stepper motor which incrementally control the level of resistance applied to the spinning flywheel. Accordingly, even when the stepper motor 41 is applying the highest level of resistance, the manually operated brake may be used to increase the amount of resistance applied to the spinning flywheel 14 in order to stop the flywheel 14. This override feature may be incorporated into the system by varying the respective range of motion of the first actuator 30 and second actuator 40, and/or by varying the size and positioning of slots 22*a* and 22*b*. In the illustrated embodiment, the first actuator 30 has a greater range of motion with respect to the lever 20 than the second actuator 40, thus providing the first actuator 30 with the ability to override the second actuator 40.

Figure 7:
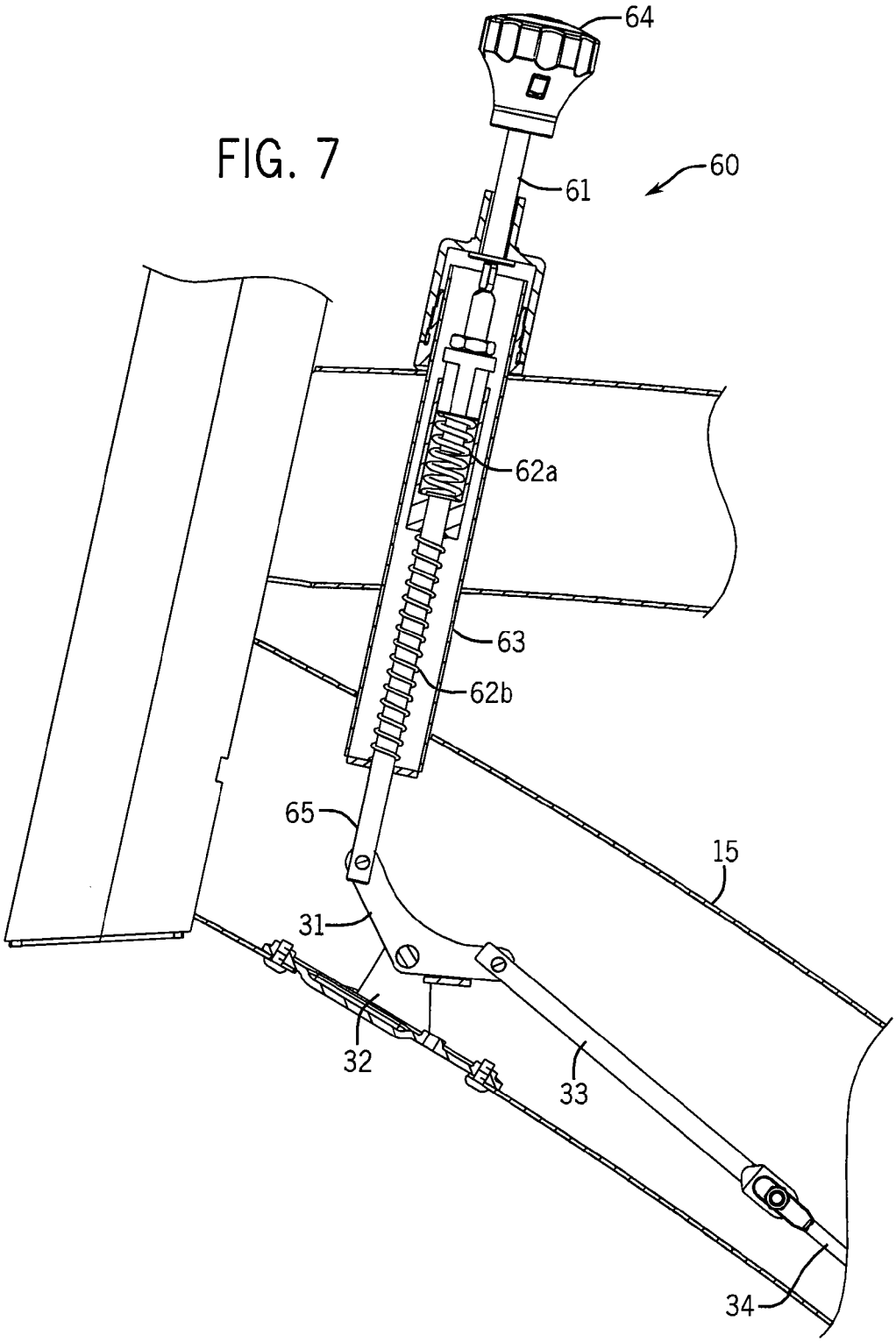
FIG. 7 illustrates a cross-sectional view of a portion of the exercise cycle and dual actuation mechanism of FIG. 1, showing a first actuator that functions as a manually operated brake for the dual actuation mechanism.

In the illustrated embodiment, the first actuator 30 is in the form of a plunger-type actuator that includes a manual actuator in the form of a plunger-type knob assembly 60 that has a shaft 61, springs 62*a* and 62*b*, a housing 63, a knob 64, and a rod 65, as shown in FIGS. 5 and 7. The knob 64 is attached to the shaft 61, which partially extends out of an opening in one end of the housing 63. The knob 64 is biased outwardly with respect to the housing 63 by a spring 62*a*, which is positioned between the shaft 61 and rod 65. More specifically, as shown in FIGS. 5 and 7, the rod 65 includes a chamber 67 at one end that houses the spring 62*a* and that also receives an enlarged end of the shaft 61, shown at 69. The chamber 67 at the upper end of rod 65 includes guide slots, and the enlarged end 69 of the shaft 61 includes ribs that are received within the guide slots of chamber 67. The spring 62*a* acts on the enlarged end 69 of shaft 61, so as to bias knob 64 outwardly. The guide slots and ribs of chamber 67 and enlarged end 69, respectively, function to ensure axial movement of shaft 61 relative to shaft 65 when knob 64 is pressed and when spring 62*a* moves knob 64 upwardly.

The lower end of the rod 65 (i.e., the end of the rod 65 that is opposite the chamber 67) extends outside of the lower end of the housing 63 (i.e., the end of the housing 63 that is opposite the knob 64) and is pivotally connected to a crank 31, e.g., by a pin connection. The spring 62*b* biases the rod 65 away from the crank 31 and inwardly toward the housing 63.

The crank 31 is pivotally connected to a bracket 32 that is in turn secured to an interior surface of the frame 15. The bracket 32 may be integral with the frame 15, or it may be secured to the frame 15 using any suitable fasteners such as screws, bolts, adhesives, welding, etc.

An actuator rod is interconnected between crank 31 and lever 20. The actuator rod is in the form of a first section 33 that is pivotally attached at one end to the crank 31, e.g., by a pin connection, and a second section 34 that is connected, e.g., via a pin connection, to the opposite end of the first section 33. As shown in FIG. 3, the rod sections 33 and 34 extend through the frame 15 through a front portion of the frame 15 (proximate a user's hands) to a rear portion of the frame 15 (proximate the flywheel). As shown in FIG. 3, the pinned connection between rod sections 33 and rod 34 enables the dual actuation mechanism 10 to function in close proximity to the pedal assembly 18, which might otherwise interfere with operation of the first actuator 30. It should be noted that rod sections 33 and rod 34 may be replaced with any suitable structure capable of exerting a pulling force on the lever 20. For example, rod sections 33 and rod 34 may be replaced with a one-piece rod, a cable, a wire, a rope a chain, or any combination thereof.

The end of rod section 34 opposite the end that is connected to rod section 33 engages the lever 20 at slot 22*a*. As shown in FIG. 5, the end of rod section 34 that engages the lever 20 has a hook 35 that is received within the slot 22*a*. It should be noted that the end of rod section 34 that engages the slot is not limited to a hook design. For example, alternative designs include a loop or a pin connection. When the first actuator 30 is used to move the lever 20, the hook 35 exerts a pulling force against the end of slot 22*a* to move the lever 20, which pivots about bracket 22 to apply the resistance element 24 against the flywheel 14.

The lever 20 is biased away from the flywheel 14 by the torsion spring 25 so that when actuation of the first actuator 30 is terminated, the torsion spring 25 returns the lever 20 to its initial position, which, as discussed above, may be dictated by the position of the second actuator 40. In other words, in the context of an exercise cycle, if the second actuator 40 is maintaining the lever 20 in an initial position corresponding with an incremental resistance labeled as level X, after the actuation of the first actuator 30 is terminated, the spring 25 will return the lever 20 to the initial position corresponding with level X. Thus, the first actuator 30 operates independently of, and without disturbing the functioning of, the second actuator 40.

Conversely, the hook 35 is sized so that when the lever 50 is actuated by the second actuator 40, the lever 20 moves with respect to the hook 35 without disturbing the hook 35. In other words, movement of the lever 20 by the second actuator 40 causes the slot 22*a* to slide with respect to the hook 35 without disturbing the hook 35 (and thus independent of and without disturbing the first actuator 30).

Figure 9:
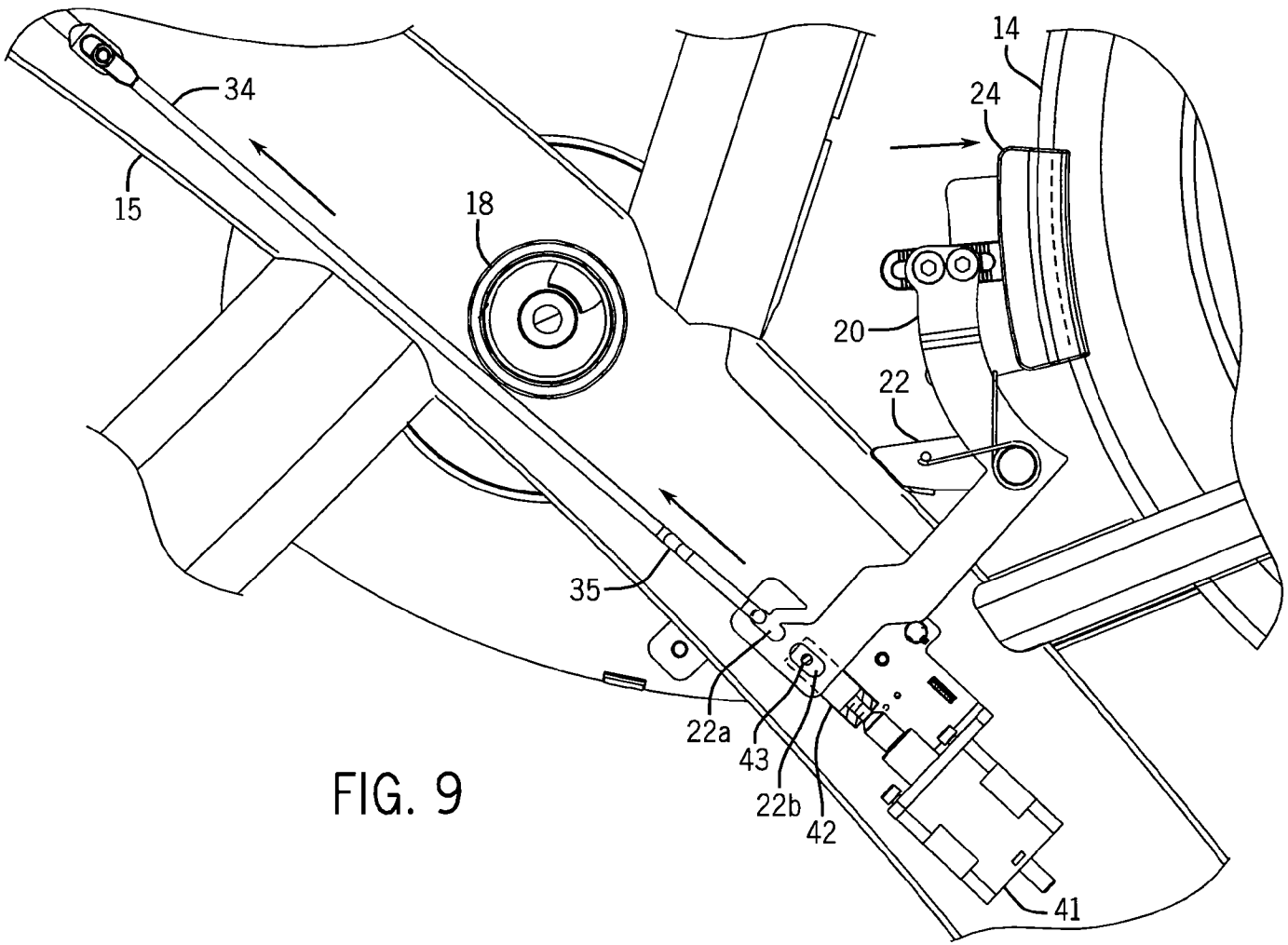
FIG. 9 is a view similar to FIG. 8, showing the mechanism in a second position in which the lever is moved in response to operation of a manually operated brake.
Figure 10:
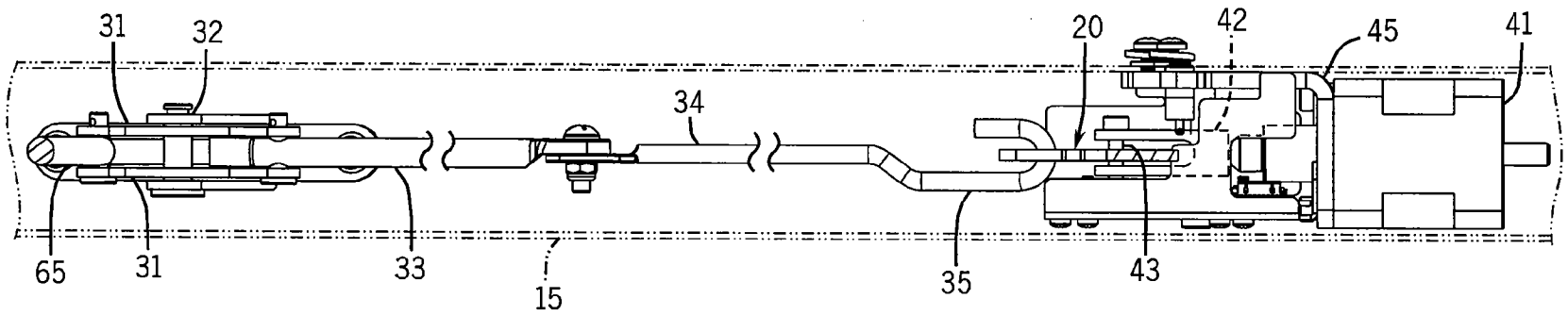
FIG. 10 is a partial section view taken along line 10-10 of FIG. 3.

As shown in FIG. 8, the second actuator 40 includes the stepper motor 41, a clevis 42 and a clevis pin 43 that engages the slot 22*b* of the lever 20, which are contained within the frame 15, as shown in FIG. 8. The stepper motor 41 is supported by a housing 45, which in turn is secured to an inner surface of the frame 15. FIG. 8 illustrates a condition in which the first actuator 30 is not operated while second actuator 40 controls the position of lever 20. In this condition, the hook 35 moves freely within the slot 22*a* while the clevis pin 43 engages the end of slot 22*b* in order to move lever 22 to a desired position. This condition provides pivoting movement of lever 20, and thereby positioning of resistance element 24, in response to operation of stepper motor 41 to allow adjustment of the resistance to rotation of flywheel 14 during normal operation of exercise cycle 12. FIG. 9 illustrates the opposite condition, in which the second actuator 40 is not operated while the first actuator 30 controls the position of lever 20. In this condition, the clevis pin 43 moves freely within the slot 22*b* while the hook 35 engages the end of slot 22*a* in order to move lever 22 to a position in which a braking force is applied to the edge of flywheel 14 by operation of resistance element 24. This condition provides pivoting movement of lever 20, and movement of resistance element 24 against the edge of flywheel 14, in response to operation of the manual actuation mechanism of first actuator 30 to stop rotation of flywheel 14. As noted above, when the manual actuation mechanism is released, the torsion spring 25 moves the lever 20 in a counterclockwise direction and returns the lever 20 to its initial position in which the clevis pin 43 engages the end of slot 22*b*, in order to subsequently allow movement of lever 22 in response to operation of the stepper motor 41. The torsion spring 25 functions to maintain the end of slot 22*b* in engagement with the clevis pin 43, so that the position of lever 20 is at all times dependent on the position of clevis pin 43 other than when the manual actuation mechanism of first actuator 30 is applied in order to stop rotation of flywheel 14.

As mentioned above, the stepper motor 41 incrementally changes the position of the lever 20, and thus the resistance applied to the flywheel 14, depending on user input received via the user interface which, as noted previously, may be in the form of handlebar-mounted computer 17. For example, the stepper motor 41 may position the lever 20 at various positions corresponding with differing levels of resistance applied to the flywheel 14. Thus, if a user desires to begin a workout at resistance level X, the stepper motor 41 moves the lever 20 to a position that corresponds with the desired resistance level. The stepper motor 41 moves the lever 20 by moving the clevis 42 to push the clevis pin 43 against the end of the slot 22*b*. As discussed above, pushing the lever 20 in this matter moves the lever 20 against the force of the spring 25. If desired, stepper motor 41 could be incorporated in a power feedback loop, which ensures that a constant, desired level of resistance is applied to the flywheel 14 for each resistance level.

It should be noted that the first actuator 30 and second actuator 40 are not limited to the above-described positioning in relation to the lever 30. Moreover, the push-pull nature of the first actuator 30 and second actuator 40 is dictated by the positioning of those components with respect to the lever 20. For example, in the illustrated embodiment, the first actuator 30 is located on one side of the lever 20 while the second actuator 40 is located on the opposite side of the lever 20. However, both the first actuator 30 and second actuator 40 may be located on the same side of the lever 20. In such an arrangement, the first actuator 30 and second actuator 40 would both either pull the lever 20 or push the lever 20 depending on the positioning. However, as discussed above, the size and positioning of the slots 22*a* and 22*b* coupled with the respective ranges of motion of the first actuator 30 and second actuator 40 enables the first actuator 30 and second actuator 40 to operate independently of one another, regardless of whether they are positioned on the same or opposite sides of the lever 20.

In the illustrated embodiment, the resistance element 24 is releasably attached (e.g., by screws, bolts, etc.) to an end of the lever 20, as shown in FIG. 8. Alternatively, the resistance element 24 may be integral with or permanently attached to the lever 20. The resistance element 24 may take the form of any component that can be used to apply resistance to a flywheel 14 based upon the proximity of the resistance element 24 to the flywheel 14. For example, the resistance element 24 may include felt pads, leather pads or calipers. The resistance element 24 may also include a magnet arrangement, which interacts with a rotating conductive member in a manner as is known to provide eddy current resistance to rotation of the rotating member, which may thus be used to resist rotation of flywheel 14. In an arrangement such as this, the lever 20 may also be provided with a brake element in addition to the magnet arrangement, which physically engages the flywheel 14 when the manual actuation mechanism is actuated in order to stop rotation of the flywheel 14.

An electronic control system may be incorporated into the computer 17, particularly to control the positioning, and thus the resistance applied by, the stepper motor 41 in response to computer software program. In the context of exercise equipment, the stepper motor 41 is particularly suitable due to its incremental nature, which corresponds with varying the intensity level of a workout based on the amount of resistance the stepper motor 41 applies to the flywheel 14 of the exercise cycle, for example.

The present invention further includes a method for using a dual actuation mechanism described in detail above. The method includes the steps of providing a lever having a resistance element configured to apply resistance to a rotating member; providing a first actuator that is operably coupled to the lever; providing a second actuator that is operably coupled to the lever; and applying resistance to the rotating member by actuating either the first actuator or the second actuator, wherein the first actuator and second actuator move the lever independent of the other. This inventive method may be applied in the context of an exercise cycle, wherein the first actuator is a manually operated brake and wherein the second actuator is an electronically controlled stepper motor that incrementally varies the resistance on a rotating member based upon user input received through a user interface such as a keypad.

Figure 11:
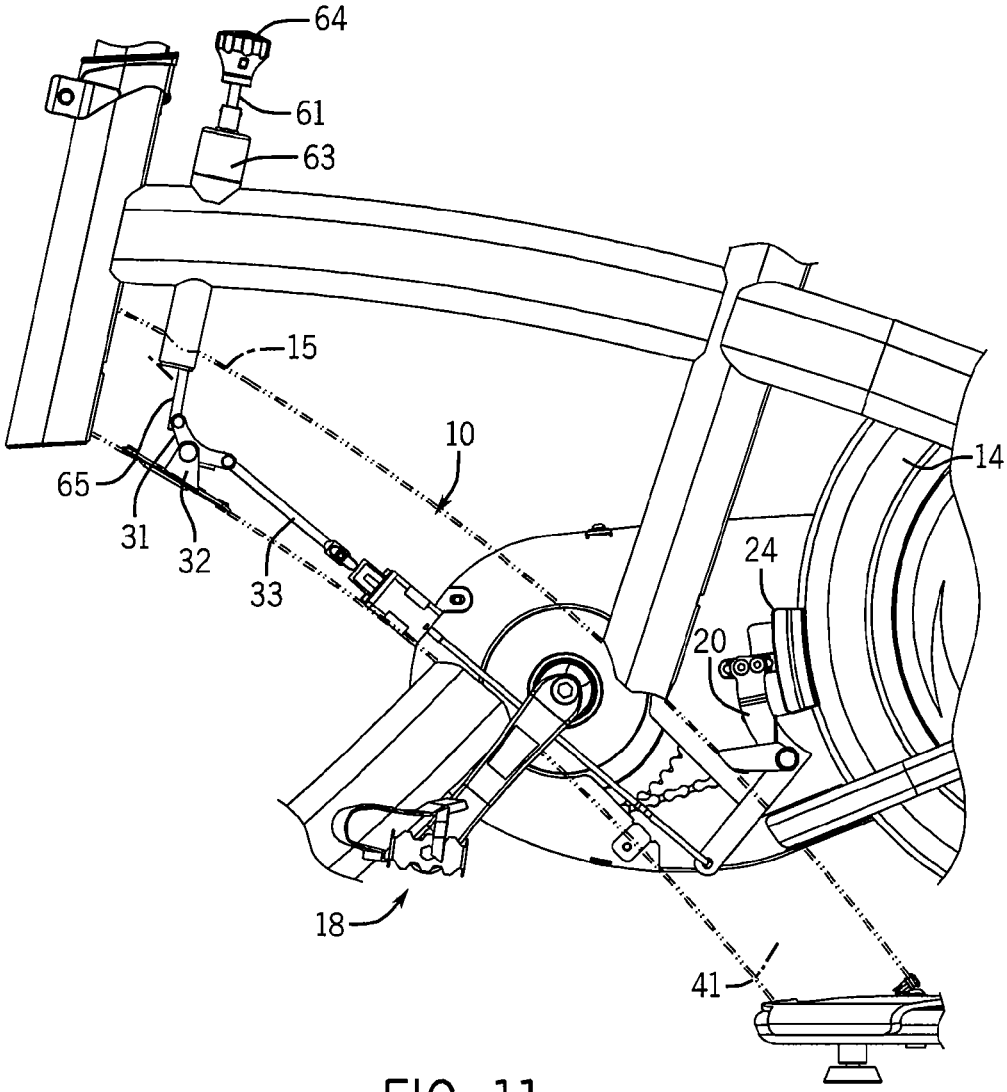
FIG. 11 is a schematic view of an exercise cycle incorporating a first alternative embodiment of a dual actuation mechanism in accordance with the present invention.

FIG. 11 illustrates an alternative embodiment of a dual actuation mechanism 10' in accordance with the present invention. The components of dual actuation mechanism 10' are illustrated schematically, and it is understood that the various components would typically be interconnected with and housed within the frame or other structure of the exercise cycle for support and protection. In this embodiment, a lever 20' may be moved using either the first actuator 30 or a second actuator shown at 40'. The first actuator 30 has the same construction and operation as described previously. In this embodiment, however, the second actuator 40', which is in the form of a motor 41', is incorporated into the mechanism that transfers motion from the first actuator 30 to the lever 20'. In this manner, the either the first actuator 30 or second actuator 40 may be used independently of the other to impart movement to lever 20'. In other words, the first actuator 30 can be applied without affecting the functioning of the second actuator 40', and vice-a-versa. Thus, in operation, the first actuator 30 applies a first force in a first direction to the lever 20' that causes the lever 20' to move without disturbing the second actuator 40'. Conversely, the second actuator 40' applies a second force in the first direction to the lever 20' that causes the lever 20' to move without disturbing the first actuator 30.

In the embodiment illustrated in FIG. 11, an actuator rod is again interconnected between crank 31 and lever 20'. The actuator rod is in the form of a first section 33' that is pivotally attached at one end to the crank 31, e.g., by a pin connection, and a second section 34'. In this embodiment, the motor 41' is connected between the lower end of first section 33' and the upper end of second section 34', such that the motor 41' is in-line with the rod sections 33' and 34'. The motor 41' includes an extendible and retractable output member that effectively serves to selectively increase or decrease the length of the rod between crank 31 and lever 20'. Representatively, the motor 41' may include a bracket 80 secured to the housing of motor 41', which is interconnected with the lower end of first rod section 33' via a pivot pin 81. The upper end of the second rod section 34' is secured to the movable output member of the motor 41', shown at 82, such that extension or retraction of the movable motor output member 82 results in axial movement of second rod section 34'. In this version, the lower end of second rod section 34' is formed with a hook 83 that extends through an opening in the lower end of lever 20' so as to pivotably interconnect the end of second rod section 34' with lever 20'.

In operation, when the dual actuation mechanism 10' is incorporated into an exercise cycle, a user can apply the first actuator 30, e.g., a manually operated brake, without affecting the controlled resistance being applied by the second actuator 40', e.g., motor 41'. In this scenario, the user presses a button or knob to actuate the manually operated brake and stop the spinning flywheel 14 (or other rotating member). When the user releases the button or knob, the manually operated brake no longer exerts a force on the lever 20'. The lever 20' then returns under the force of the torsion spring 25 to a position determined by the resistance setting of the stepper motor 41'. Thus, while the stepper motor 41' is set to an initial resistance setting corresponding with a position of the lever 20' in relation to the flywheel 14, the manually operated brake can be used to stop the spinning flywheel 14. Once the manually operated brake is released, the lever 20, under the force of the spring 25, returns to the position corresponding with the resistance setting of the stepper motor 41'. At other times during operation of the exercise cycle, the resistance to rotation of flywheel 14 is controlled by stepper motor 41'. In this scenario, the axial position of the stepper motor 41' relative to first rod section 33' is fixed due to the dual pin connections at the ends of first rod section 33'. The output member of stepper motor 41', which is secured to the upper end of second rod section 34', can only move axially such that the pin connection of the lower end of second rod section 34' results in motor 41' acting to control the effective length of the rigid rod between crank 31 and lever 20'. Accordingly, when motor 41' is operated to extend the motor output member, lever 20' is rotated counterclockwise to decrease the resistance to rotation of flywheel 14. Conversely, when motor 41' is operated to retract the motor output member, lever 20' is rotated clockwise to increase the resistance to rotation of flywheel 14.

Figure 12:
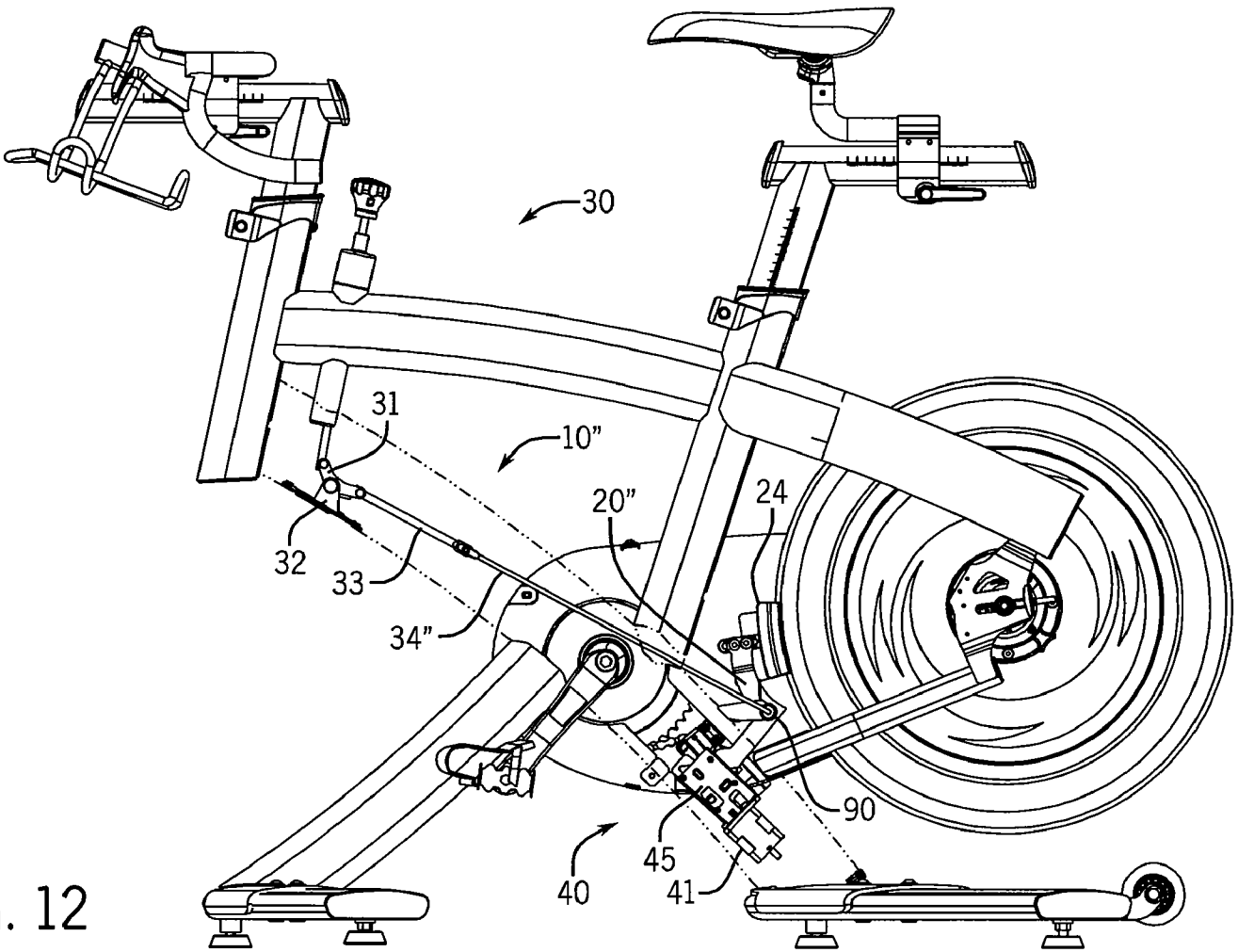
FIG. 12 is a schematic view of an exercise cycle incorporating a second alternative embodiment of a dual actuation mechanism in accordance with the present invention.

FIG. 12 illustrates another alternative embodiment of a dual actuation mechanism in accordance with the present invention, shown at 10". Again, it is understood that the components of dual actuation mechanism 10" are illustrated schematically, and that the various components would typically be interconnected with and housed within the frame or other structure of the exercise cycle for support and protection. Generally, the dual actuation mechanism 10" includes similar components as the dual actuation mechanism 10 shown and described with respect to FIGS. 1-10. However, in this embodiment, bracket 32 and crank 31 are inverted, such that actuation of first actuator 30 applies an axial pushing force on the rod, which in this embodiment includes a first section 33 as in the first embodiment, in combination with a second section 34" that is secured to the end of first section 33. The opposite end of second rod section 34" is secured to a stud 90, which in turn is rigidly secured to the central area of the lever, shown at 20". In this embodiment, the lower end of the lever 20" is pivotably secured to the output member of the motor 41, such as via a transverse pin connection (not shown). In other respects, the first actuator 30 and the second actuator 40 have the same construction and operation as shown and described with respect to the first embodiment.

In the embodiment of FIG. 12, the lever 20" may again be moved using either the first actuator 30 or the second actuator 40. Again, either the first actuator 30 or second actuator 40 may be used independently of the other to impart movement to lever 20". In other words, the first actuator 30 can be applied without affecting the functioning of the second actuator 40, and vice-a-versa. Thus, in operation, the first actuator 30 applies a first force in a first direction to the lever 20" that causes the lever 20" to move without disturbing the second actuator 40. Conversely, the second actuator 40 applies a second force in the first direction to the lever 20" that causes the lever 20" to move without disturbing the first actuator 30.

In operation, when the dual actuation mechanism 10" is incorporated into an exercise cycle, a user can apply the first actuator 30, e.g., a manually operated brake, without affecting the controlled resistance being applied by the second actuator 40, e.g., motor 41. In this scenario, the user presses a button or knob to actuate the manually operated brake and stop the spinning flywheel 14 (or other rotating member). When the first actuator 30 is operated, the rod 34" is axially pushed rearwardly so as to move the stud 90 rearwardly. The lever 20" thus pivots about a lower pivot point defined by the connection of the lever 20" to the output member of the motor 41, to pivot the lever 20" in a counterclockwise direction to move the resistance element 24 against the flywheel 14. When the user releases the button or knob, the manually operated brake no longer exerts a force on the lever 20". The lever 20" then returns under the force of the torsion spring 25 to a position determined by the resistance setting of the stepper motor 41, which corresponds to the position of the motor output member. Thus, while the stepper motor 41 is set to an initial resistance setting corresponding with a position of the lever 20" in relation to the flywheel 14, the manually operated brake can be used to stop the spinning flywheel 14. Once the manually operated brake is released, the lever 20", under the force of the spring 25, returns to the position corresponding with the resistance setting of the stepper motor 41'. At other times during operation of the exercise cycle, the resistance to rotation of flywheel 14 is controlled by stepper motor 41. In this scenario, the position of the stud 90 is fixed, and lever 20" is pivotable about a pivot point defined by stud 90. Accordingly, when stepper motor 41' is operated to extend or retract its output member, lever 20" is pivoted about stud 90 to either increase or decrease the resistance to rotation of flywheel 14 applied by resistance element 24. Accordingly, when motor 41 is operated to extend the motor output member, lever 20" is rotated clockwise about stud 90 to increase the resistance to rotation of flywheel 14. Conversely, when motor 41 is operated to retract the motor output member, lever 20" is rotated counterclockwise about stud 90 to decrease the resistance to rotation of flywheel 14.

The dual actuation mechanism of the present invention is not limited to use in connection with an exercise cycle—this is only one exemplary embodiment. The dual actuation mechanism of the present invention may be incorporated into any system that requires resistance applied to a rotating member (or any moving element) by more than one actuator. Further, the dual actuation mechanism of the present invention is not limited to a two-actuator embodiment. For example, additional actuators could be coupled with a single lever, or further, additional levers and/or actuators can be incorporated into the dual actuation mechanism of the present invention. Still further, the first actuator and second actuator are not limited to the specific examples described above, i.e., a plunger-type manually operated linkage and a stepper motor. Any actuation device capable of moving a lever may be used as an actuator with respect to the dual actuation mechanism of the present invention.

Although exemplary modes contemplated by the inventors of carrying out the present invention are disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Further, although the dual actuation mechanism described herein is a physically separate module, it will be manifest that the may be integrated into the apparatus, e.g., an exercise cycle, with which it is associated. Furthermore, all the disclosed features of each disclosed embodiment can be combined with, or substituted for, the disclosed features of every other disclosed embodiment except where such features are mutually exclusive.

What is claimed is:

1. A dual actuation mechanism comprising:

a lever mounted to a support for movement about a pivot axis;

a resistance element supported by the lever;

a first movable actuator operably connected to the lever, wherein the first actuator causes pivoting movement of the lever in a first direction about the pivot axis when the first actuator is actuated so as to impart movement to the resistance element; and a second movable actuator operably connected to the lever, wherein the second actuator causes pivoting movement of the lever in the first direction about the pivot axis when the second actuator is actuated so as to impart movement to the resistance element;

wherein the first actuator and the second actuator move the lever in the first direction independent of each other, and wherein actuation of the first actuator causes movement of the lever in the first direction without imparting movement to the second actuator, and wherein actuation of the second actuator causes movement of the lever in the first direction without imparting movement to the first actuator.

2. The dual actuation mechanism of claim 1, further comprising:

a first slot in the lever for receiving the first actuator, wherein the first actuator applies a first force against a surface defined by the first slot when the first actuator is actuated to cause pivoting movement of the lever in the first direction; and a second slot in the lever for receiving the second actuator, wherein the second actuator applies a second force against a surface defined by the second slot when the second actuator is actuated to cause pivoting movement of the lever in the first direction.

3. A dual actuation mechanism comprising:

a lever;

a resistance element supported by the lever;

a first actuator operably connected to the lever; and a second actuator operably connected to the lever, wherein the first actuator and the second actuator move the lever independent of the other;

a first slot in the lever for receiving the first actuator, wherein the first actuator applies a first force in a first direction against a surface defined by the first slot when the first actuator is actuated; and a second slot in the lever for receiving the second actuator, wherein the second actuator applies a second force in the first direction against a surface defined by the second slot when the second actuator is actuated;

wherein the second actuator includes a motor having an output member, a clevis interconnected with the output member, and a clevis pin carried by the clevis and received within the second slot.

4. The dual actuation mechanism of claim 3, wherein the first actuator includes a rod having a hooked end that is received within the first slot.

5. The dual actuation mechanism of claim 2, wherein the lever is spring biased in a second direction about the pivot axis opposite the first direction.

6. The dual actuation mechanism of claim 5, wherein movement of the lever in the first direction causes the resistance element to apply resistance to a rotating member.

7. The dual actuation mechanism of claim 6, wherein the first actuator and second actuator are positioned on opposite sides of the lever, wherein the first force applied by the first actuator is a pulling force, and wherein the second force applied by the second actuator is a pushing force.

8. The dual actuation mechanism of claim 7, wherein the first actuator and the second actuator are substantially contained within a frame that includes the support to which the lever is mounted for movement about the pivot axis.

9. A dual actuation mechanism comprising:

a lever;

a resistance element supported by the lever, wherein the resistance element is configured to apply resistance to a rotating member;

a first actuator operably connected to the lever; and a second actuator operably connected to the lever, wherein the first actuator and second actuator are positioned on opposite sides of the lever, wherein the first force applied by the first actuator is a pulling force, and wherein the second force applied by the second actuator is a pushing force, and wherein the first actuator and the second actuator move the lever independent of the other;

a first slot in the lever for receiving the first actuator, wherein the first actuator applies a first force in a first direction against a surface defined by the first slot when the first actuator is actuated, and a second slot in the lever for receiving the second actuator, wherein the second actuator applies a second force in the first direction against a surface defined by the second slot when the second actuator is actuated;

wherein the first actuator and the second actuator are substantially contained within a frame, and wherein the frame is part of an exercise cycle having a flywheel, wherein the resistance element is operable to resist rotation of the flywheel.

10. The dual actuation mechanism of claim 1, wherein the first actuator and the second actuator include a rod secured to the lever, wherein a portion of the length of the rod comprises a motor having an output member, wherein the first actuator acts on the lever through the rod and the motor independent of operation of the motor, and wherein the second actuator acts on the lever by operation of the motor to selectively alter the effective length of the rod and cause movement of the lever.

11. The dual actuation mechanism of claim 1, wherein the first actuator includes a rod pivotably secured to the lever at a first location, and wherein the second actuator includes a motor having an output member pivotably secured to the lever at a second location spaced from the first location, wherein operation of the first actuator functions to pivot the lever about the pivot axis by application of a force to the lever from the rod at the first location, and wherein operation of the second actuator functions to pivot the lever about the pivot axis by application of a force to the lever from the motor output member at the second location.

12. A dual actuation mechanism comprising:

a lever having a first slot and a second slot, wherein the lever is mounted to a support for movement about a pivot axis;

a first movable actuator operably coupled with the lever at the first slot, wherein the first actuator causes pivoting movement of the lever in a first direction about the pivot axis when the first actuator is actuated; and a second movable actuator operably coupled with the lever at the second slot, wherein the second actuator causes pivoting movement of the lever in the first direction about the pivot axis when the second actuator is actuated;

wherein the first actuator and the second actuator move the lever in the first direction independent of each other;

wherein the first slot is sized to allow for movement of the first slot with respect to the first actuator when the lever is moved by the second actuator such that actuation of the second actuator causes movement of the lever in the first direction without imparting movement to the first actuator; and wherein the second slot is sized to allow for movement of the second slot with respect to the second actuator when the lever is moved by the first actuator such that actuation of the first actuator causes movement of the lever in the first direction without imparting movement to the second actuator.

13. The dual actuation mechanism of claim 12, wherein, when actuated, the first actuator moves the lever by pulling against a surface defined by the first slot.

14. The dual actuation mechanism of claim 13, wherein, when actuated, the second actuator moves the lever by pushing against a surface defined by the second slot.

15. The dual actuation mechanism of claim 14, further comprising a resistance element supported by the lever.

16. A dual actuation mechanism comprising:

a lever having a first slot and a second slot;

a resistance element supported by the lever;

a first actuator operably coupled with the first slot, wherein, when actuated, the first actuator moves the lever by pulling against a surface defined by the first slot, wherein the first actuator includes a rod that is coupled with the first slot; and a second actuator operably coupled with the second slot, wherein, when actuated, the second actuator moves the lever by pushing against a surface defined by the second slot, wherein the second actuator includes a stepper motor, a clevis and a clevis pin that is received within the second slot;

wherein the first slot is sized to allow for movement of the first slot with respect to the first actuator when the lever is moved by the second actuator; and wherein the second slot is sized to allow for movement of the second slot with respect to the second actuator when the lever is moved by the first actuator.

17. The dual actuation mechanism of claim 16, wherein the rod, stepper motor, clevis and clevis pin are substantially contained within a frame of an exercise cycle, wherein the resistance element is applied to a rotating member of the exercise cycle by moving the lever with either the first or second actuator, and wherein the lever is spring biased away from the rotating member.

18. The dual actuation mechanism of claim 17, wherein a first part of the lever proximate the first and second actuators is contained within the frame and wherein a second part of the lever proximate the resistance element is outside of the frame, and wherein the lever is pivotably supported by a bracket attached to the exterior of the frame.

19. The dual actuation mechanism of claim 18, wherein the resistance element is configured to engage a surface of the rotating member.

20. The dual actuation mechanism of claim 15, wherein the first slot and second slot are linearly aligned.

* * * * *